United States Patent [19]

Peugeot

[11] Patent Number: 4,521,902

[45] Date of Patent: Jun. 4, 1985

[54] MICROFOCUS X-RAY SYSTEM

[75] Inventor: Richard S. Peugeot, Stone Mountain, Ga.

[73] Assignee: Ridge, Inc., Tucker, Ga.

[21] Appl. No.: 510,660

[22] Filed: Jul. 5, 1983

[51] Int. Cl.[3] ..... H05G 1/00; H05G 1/64

[52] U.S. Cl. ..... 378/138; 378/99; 378/113; 378/123

[58] Field of Search ..... 378/138, 43, 91, 99, 378/113, 123

[56] References Cited

U.S. PATENT DOCUMENTS

| | | | |
|---|---|---|---|
| 2,866,113 | 12/1958 | Cosslett | 378/138 |
| 2,877,353 | 3/1959 | Newberry | 378/138 |
| 2,922,904 | 1/1960 | Zunick | 378/043 |
| 4,130,759 | 12/1978 | Haimson | 378/138 |
| 4,159,436 | 6/1979 | Ely | 378/138 |

*Primary Examiner*—Alfred E. Smith
*Assistant Examiner*—T. N. Grigsby
*Attorney, Agent, or Firm*—C. A. Phillips; Michael L. Hoelter

[57] ABSTRACT

A microfocus type X-ray system in which the electron beam power is generally operated in a milliampere range at a constant power, and the beam is subjected to electromagnetic focusing for selected beam width.

5 Claims, 7 Drawing Figures

MICROFOCUS X-RAY SYSTEM

FIELD OF THE INVENTION

This invention relates generally to X-ray systems, and more particularly to a microfocus-type system capable of operating at substantially increased operating levels.

BACKGROUND OF THE INVENTION

X-ray equipment may be considered as being of the general category or of the microfocus category. In the general category, the X-ray beam is not subjected to substantial focusing, and the beam spot size is on the order of 0.5 mm to 5.0 mm; whereas, in the microfocus category, the beam is focused in a manner to achieve a quite small spot size, on the order of 10 to 200 microns. Obviously, much greater detail or resolution of viewing is achieveable with the smaller spot size of the microfocus equipment. Up until this time, microfocus systems which provided such detail simply did not provide sufficient X-ray output to enable real time viewing, as, for example, adequate for employment with image intensifier-display systems. Instead, one was required to expose photographic film to produce a visual image, which is a slow process since the film must be developed and which also is by its nature an expensive one.

In view of this situation, there is clearly a need for a microfocus-type system which will provide both a small focal spot size and an X-ray output having a radiation level sufficient for the operation of real time imaging equipment.

SUMMARY OF THE INVENTION

In accordance with the present invention, the applicant has determined a microfocus X-ray system which may be reliably operated to produce quite fine, 10–20 microns, focal spot sizes with electron beam levels on the order of 100 times those previously employed. This has been accomplished with a triode electron beam structure together with a system of focusing wherein electrostatic focusing effects are varied as a function of electron beam power and electromagnetic focusing that is effected as a function of anode potential. Also, means are provided to readily vary the position of the electron beam on its target and therefore the exit point of the X-ray beam from the X-ray tube. As a further feature, the tube is demountable for convenient target, anode, grid and filament replacement, enabling economical higher level usage of the tube without danger of losing the tube as a whole.

DETAILED DESCRIPTION OF THE DRAWINGS

Figures 1, 2:
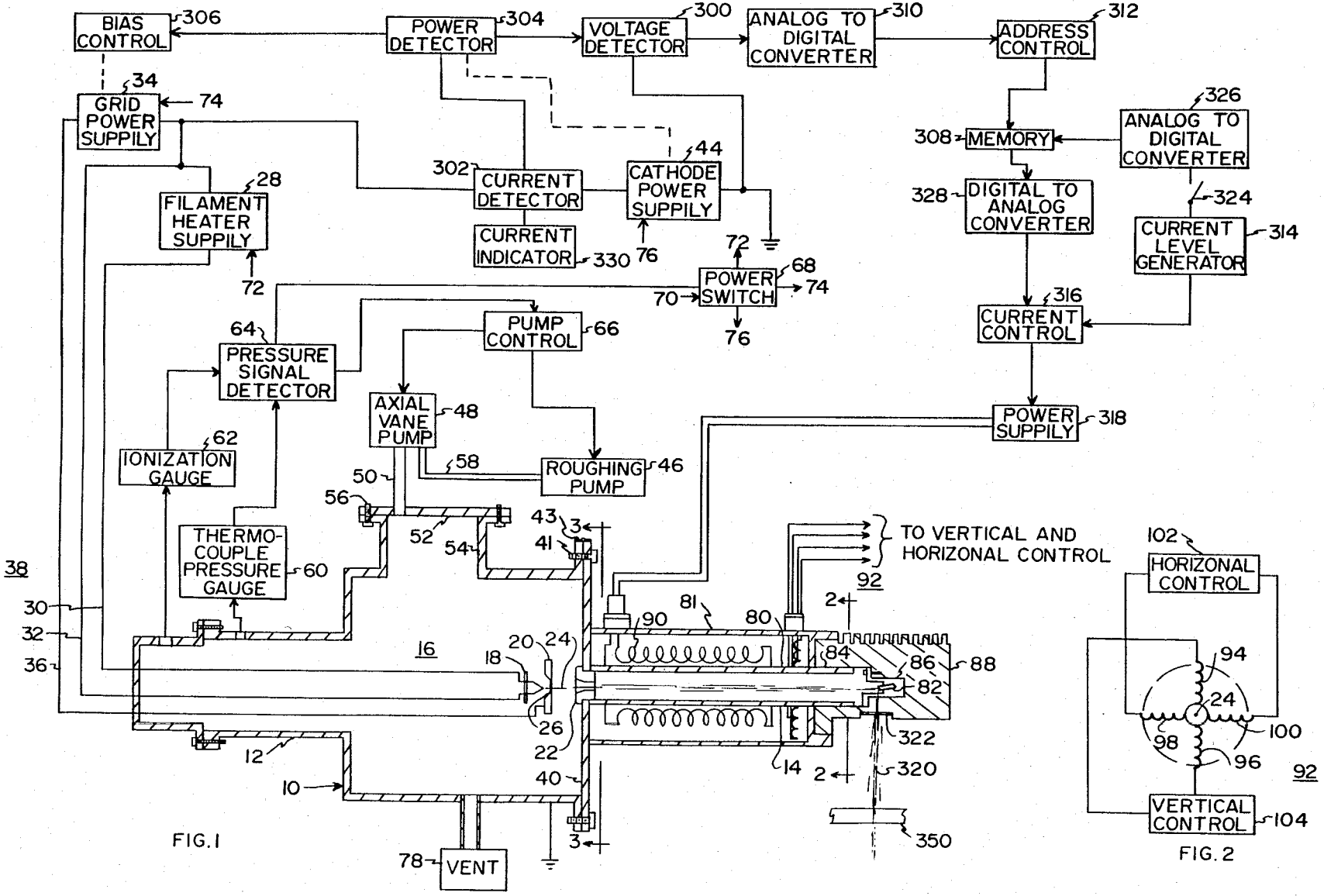
FIG. 1 is a block diagram illustrating the various components of this invention.
FIG. 2 is a sectional view, partially cut away, taken along line 2—2 of FIG. 1.

FIG. 1 generally illustrates an X-ray system as contemplated by this invention. It is what may be classified as a microfocus system in that it functions to emit an X-ray beam having a spot size in the range of 10–20 microns. It employs a high vacuum X-ray tube 10 formed of basically two separable housings or chambers, electron beam generation chamber 12 and drift tube chamber 14. A triode type electron beam gun assembly 16 is positioned within chamber 12 and employs a filament-cathode 18, a bias grid 20, and a first anode 22. Filament-cathode 18 and grid 20 are of a construction particularly illustrated in FIGS. 4–6 and are electrically connected such that grid 20 is conventionally negatively biased with respect to filament-cathode 18 (FIG. 1). Electron beam 24 passes through an annular opening 26 in grid 20 and is electrostatically focused into a narrow electron beam by grid 20. Heater power for filament-cathode 18 is supplied from filament heater supply 28 through leads 30 and 32 to tube 10. The biasing potential for grid 20 is provided by grid power supply 34 wherein the positive terminal is connected to filament-cathode lead 32, and the negative terminal is connected to grid 20 through lead 36. Typically, the three leads 30, 32, and 36 would be combined in a single insulated cable 38.

Electron beam 24 is drawn under the influence of first anode 22, which is removably mounted on plate 40 between chambers 12 and 14. Plate 40 is secured to chamber 12 by bolts 41 (FIG. 3) spaced along the circumference of plate 40 and by hinge 43 which permits plate 40 to pivot. Anode 22 is annular in shape, having a central opening 42 (FIG. 3), and it is conventionally biased positive with respect to filament-cathode 18 by cathode power supply 44. This is accomplished by placing chamber 12 (and thus anode 22 and chamber 14) at ground potential and applying a negative potential to filament-cathode 18 with respect to the ground reference.

The vacuum present within vacuum tube 10 when it is operating is approximately $10^{-5}$ Torr. Rough vacuum pressure is obtained by coarse or rough pressure pump 46, and a fine vacuum pressure is obtained by an axial vane pump 48. Pump 48 is directly coupled via pipe 50 to a flange plate 52 which covers an access opening 54 in tube 10 and is sealably (by seals not shown) bolted in place by bolts 56. Roughing pump 46 is conventionally coupled by a pipe 58 through vane axial pump 48 to the interior of tube 10. Roughing pump 46 is employed to initiate vacuum pumping and is operated to pump down the pressure in tube 10 from atmospheric pressure to approximately $10^{-1}$ Torr, after which axial vane pump 48 is operated to increase this vacuum to an operating pressure of approximately $10^{-5}$ Torr. The pressure level within chambers 12 and 14 is monitored by thermocouple pressure gauge 60 and Penning or ionization gauge 62. Thermocouple pressure gauge 60 measures lower vacuum levels, and ionization gauge 62 measures higher vacuum levels. Both gauges 60 and 62 are of conventional construction and in their usage here provide electrical outputs representative of their measurements to pressure signal detector 64. Detector 64 is a commercially available device which combines the signal outputs of the two-range gauges and provides appropriate turn-on signals to pump control 66 to turn on either roughing pump 46 or axial vane pump 48, as required. Additionally, detector 64 provides a control signal to power switch 68 to close switch 68 when an operating vacuum is present. Power switch 68 is connected between A.C. inlet power lead 70 and outlet power leads 72, 74, and 76 which power, respectively, filament heater supply 28, grid power supply 34, and cathode power supply 72.

Vent valve 78 enables the vacuum within tube 10 to be released, which enables the opening of tube 10 for replacement of interior components or other service.

Drift chamber 14 is formed of an elongated brass cylinder 80 through which electrons, which have been accelerated by first anode 22, travel at nearly the speed of light until they impinge upon tungsten target 82. Tungsten target 82 is removably secured in end region 84 of brass cylinder 80 to a metal holder (as by a friction or interference fit) and heat sink 86 which is bolted to an end plate 88 generally forming a second anode. Second anode 88 slips over the end of brass cylinder 80 and is sealably attached to cylinder 80 by an O-ring and screws not shown.

A focusing coil 90 positioned within a removable coil housing 81 is wound around cylinder 80, and it creates a focusing electromagnetic field through which the electrons drift or travel. This field concentrates or converges the electrons into a narrower electron beam, being adjusted to be on the order of 10 to 20 microns when it strikes target 82. A beam deflection assembly 92 (FIG. 2) is arranged within coil housing 81 between focusing coil 90 and tungsten target 82, and it consists of a pair of vertical deflection coils 94 and 96 and a pair of horizontal deflection coils 98 and 100. Horizontal deflection coils 98 and 100 are powered and controlled by a conventional horizontal control 102 which differentially energizes the horizontal coils to effect a side-to-side deflection of beam 24 and thereby the lateral position of the focal spot on target 82 when it is struck by beam 24. Vertical deflection coils 94 and 96 are powered and controlled by a conventional vertical control 104 which applies a selected differential voltage to the vertical coils to effect control of the vertical positioning of the focal spot on target 82. By virtue of this control arrangement, the point of impingement of beam 24 on target 82 may conveniently be periodically moved, and thus the whole surface of the target may be adjustably impinged upon to enable even wearing away of the target and thus its full utilization. This, of course, enables a longer effective target life. The electron beam may also be electronically swept or moved in a stepwise or continuous fashion to effect multiple focal spot locations or a focal spot locus as may be required for tomography or stereoimaging. Target life is further extended by the employment of a doped powdered metallurgy tungsten target (as opposed to vacuum melted tungsten) and by adding to the composition of the tungsten a small percentage, approximately 2%, of thorium.

Figures 3, 4, 5:
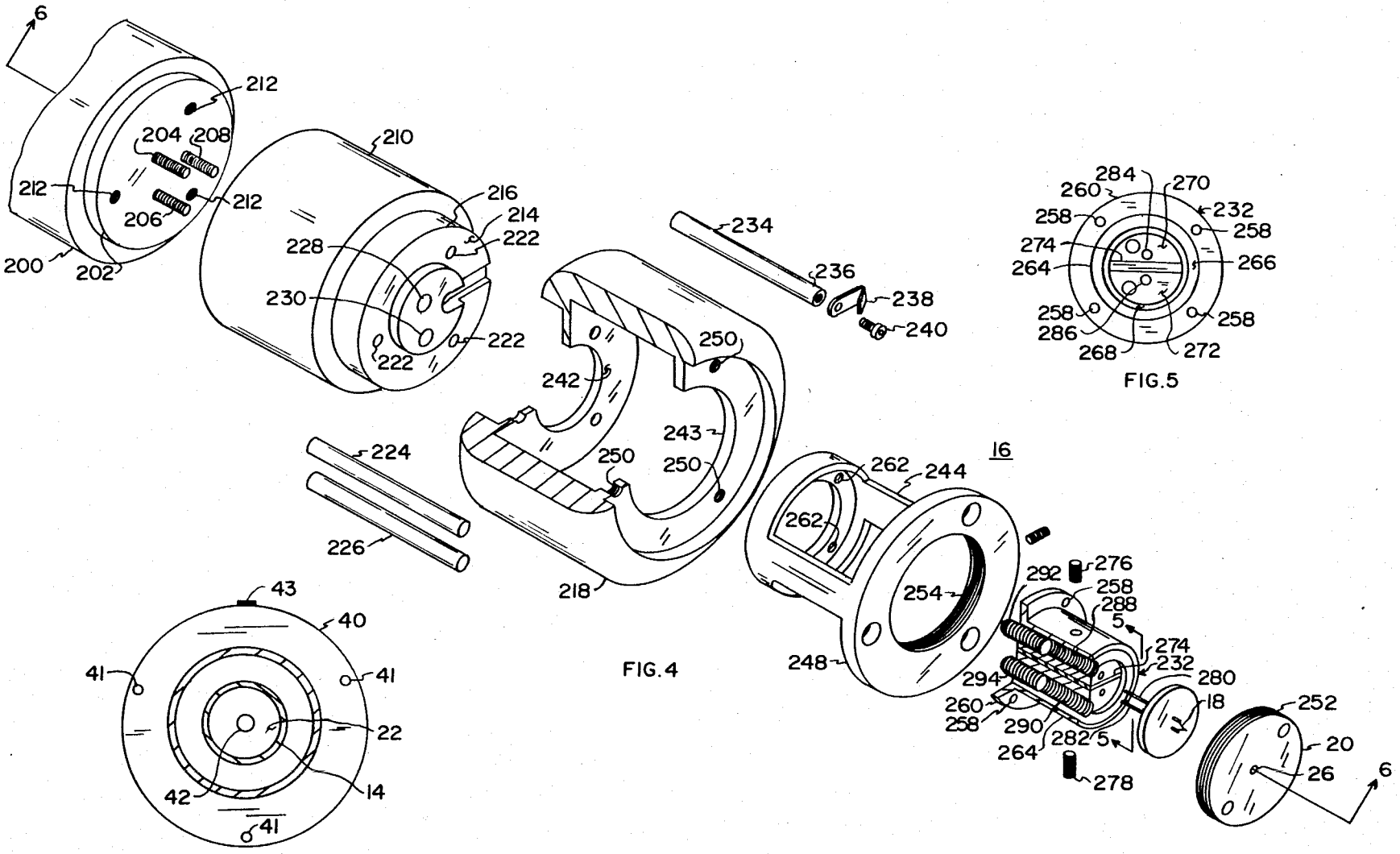
FIG. 3 is a sectional view, partially cut away, taken along line 3—3 of FIG. 1.
FIG. 4 is an exploded view of the electron gun assembly.
FIG. 5 is a sectional view, partially cut away, taken along line 5—5 of FIG. 4 of a portion of the filament socket assembly.
Figure 6:
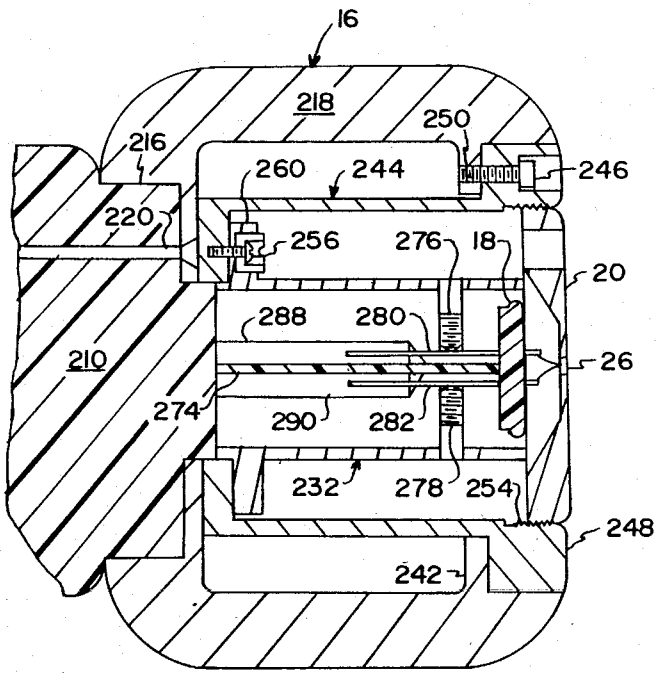
FIG. 6 is a sectional view taken along line 6—6 of FIG. 4 of the assembled electron gun assembly.

FIGS. 4–6 illustrate the unique construction of electron gun assembly 16. Electron gun assembly 16 is mounted on an insulated feed through cable connector 200 which extends through the wall of tube 10 (FIG. 1). Connector 200 is only partially shown, with the outside of the end region 202 being cylindrical, as shown. There are three threaded conductive pins extending from cable connector 200. Of these, pins 204 and 206 are filament powered pins which are connected to conductors 30 and 32 of FIG. 1. The third pin 208 is a threaded pin which supplies a grid bias potential, and it is connected to conductor 36 (FIG. 1). An insulated support 210 has an inner end diameter (not shown) on its left side which fits over cylindrical end region 202 of connector 200 and is supported thereby. Three threaded openings 212 in connector 200 (the entire connector acts as an insulator/standoff) are adapted to commonly support the several elements of electron gun assembly 16. Thus, the outer (right) end 214 of support 210 has a reduced diameter region 216 adapted to support what is termed a bias cup 218 which is supported on support 210 by bolts 220 (FIG. 6). These bolts basically secure together through openings 222, bias cup 218, insulated support 210, and cable connector 200.

Filament 18 is powered from threaded conductive pins 204 and 206 through conductive rods 224 and 226 which thread over (by threads not shown) pins 204 and 206, respectively. Conductive rods 224 and 226 extend through openings 228 and 230 in insulated support 210 and appear as contacting posts for connection to filament socket assembly 232. Third conductive rod 234 extends through support 210 and has a threaded end which threads over pin 208 of cable connector 200. The opposite end 236 of conductive rod 234 is also threaded, and a spring-type electrical contact 238 is attached by bolt 240 to it. When in place, spring contact 238 fits generally within bias cup 218 and within cutout 219 in support 210. This spring contact 238 engages flange 242 of bias cup 218 whereby bias cup 218, being metal, is generally maintained at bias potential.

Filament-grid support 244, being connected via bolts 246 (FIG. 6) to bias cup 218 and being metal, is also generally held to bias potential. Bolts 246 extending through flange 248 of filament grid support 244 and into threaded openings 250 within flange 243 of bias cup 218. Grid 20 has external threads 252 and is secured to filament-grid support 244 by screwing it into mating threads 254 in flange 248. In this fashion, the grid bias on filament-grid support 244 is supplied to grid 20.

Filament socket assembly 232 is secured by bolts 256 (FIG. 6) through its openings 258 in flange 260 to threaded openings 262 in filament-grid support 244. Thus, filament socket assembly 232 is generally positioned within filament-bias support 244, with its filament 18 being positioned just interior of flange 248 of filament-grid support 244. Filament socket assembly 232 is formed with an outer tubular member 264 of insulating material. Interior of it is a metal cylinder 266 (FIG. 5), and interior of it is insulating sheath 268. Two semi-circular conductive blocks 270 and 272, separated by insulating sheath 274, are positioned within sheath 268. They are secured in place by set screws 276 and 278. Filament terminals 280 and 282 of filament 18 frictionally fit within receptacles 284 and 286 of blocks 270 and 272. These terminals 280 and 282 are electrically connected to conductive rods 224 and 226 via a pair of threaded spring-extensible contacting members 292 and 294 within cavities 288 and 290 to effect a spring biased connection between the filament terminals 280 and 282 and rods 224 and 226.

By virtue of the construction just described, and the fact that plate 40 is removable from tube 10, repair and replacement of any of the elements of electron gun assembly 16 or target 82 is possible. As is evident from its construction, insulated support 210, which has connected to it bias cup 218, grid support 244, filament socket assembly 232, and grid 20, is separable from cable connector 200 and provides a plug-in assembly between support 210 and connector 200. Additionally, filament socket assembly 232 and grid 20 are separable from support 244, which provides for easy replacement of these components. To obtain access to these components, it is necessary to release the vacuum within tube 10 via vent valve 78 and to dissamble tube 10 by removal of bolts 41 and pivoting chamber 14 with respect to chamber 20 about hinge 43.

The operation of X-ray tube 10 is basically adjustable by the adjustment of cathode power supply 44 (FIG. 1), which would typically be manually (directly or by remote control) accomplished with settings chosen as a function of the particular object to be X-rayed. The magnitude of the voltage provided by power supply 44 is detected by voltage detector 300 and the current by current detector 302 in series with the output of power supply 44. The outputs of voltage detector 300 and current detector 302 are provided to power detector 304 which provides, as an output, a signal representative of the product of current and voltage and thus the power of the electron beam circuit. This power output signal is provided to control grid bias control 306 which controls grid power supply 74 to control the bias voltage as a direct function of power applied to the beam. In this manner, the actual power in the electron beam may be held constant at a selected value. As a feature of this invention, it is held in the range of from 0 to 800 watts, a 100 times increase in power levels for microfocus systems of similar focal spot sizes.

As another feature of this invention, coordinate with changes in cathode voltage, focusing coil 90 is controlled to optimumly vary the power (as by voltage) input to focusing coil 90 as required to maintain a minimum beam diameter of the beam when it impinged on target 82. As an example of a means of accomplishing this, the signal values for the focusing coil current, or voltage input levels, occurring with respect to the anode voltage levels, are stored in a memory 308. Coordinate signals representative of discrete synchronized cathode voltage levels are fed from voltage detector 300 to analog-to-digital converter 310, which then digitizes these signals and supplies them to a conventional address control 312 which employs them to determine discrete address memory locations in memory 308. Initially, with a selected discrete cathode voltage level (typically a peak or minimum value) and a coordinate address in memory 308 enabled, current level generator 314 would be adjusted to operate current control 316 to control power supply 318. This power supply then provides to focusing coil 90 an electrical input level which produces a minimum electron beam spot size (at target 82) which is determined by observing the resultant X-ray beam 320 emanating from target 82 through demountable window 322. When this level is determined, switch 324 is operated closed to enable analog-to-digital converter 326 to sample the current (or voltage) level present and supply a representative signal of this level to the address of memory 308 just enabled as described. This process would be repeated through the range of operation of anode-cathode voltages, and memory 308 would be programmed with a complete set of cathode voltage-focusing current signal coordinates. Thereafter, the system would operate automatically, and thus with a selected cathode voltage, analog-to-digital converter 310 would, via address control 312, provide an address signal for a discrete cathode voltage level to memory 308, which would then supply to digital-to-analog converter 328 an appropriate coordinate current (or voltage) level signal which would then be supplied to current (or voltage) control 316 which would cause power supply 318 to power focusing coil 90 with an optimum level of input.

By virtue of the combination of automatic power control and automatic focusing control, there is provided a system which enables simple but precise control of the X-ray beam and wherein the only operator control needed is the selection of anode voltage. With this accomplished, the system is operated at the most effective mode of operation. Manual control of focal spot size is also provided because at times it may be desirable to defocus slightly in the interest of longer X-ray target life or if too much detail is shown in the X-ray image. This is accomplished by reference to beam current, visually indicated by milliampere meter current indicator 330 and disabling automatic control of power supply 318. Alternately, power supply 318 would be manually controlled, conventionally by means not shown.

Figure 7:
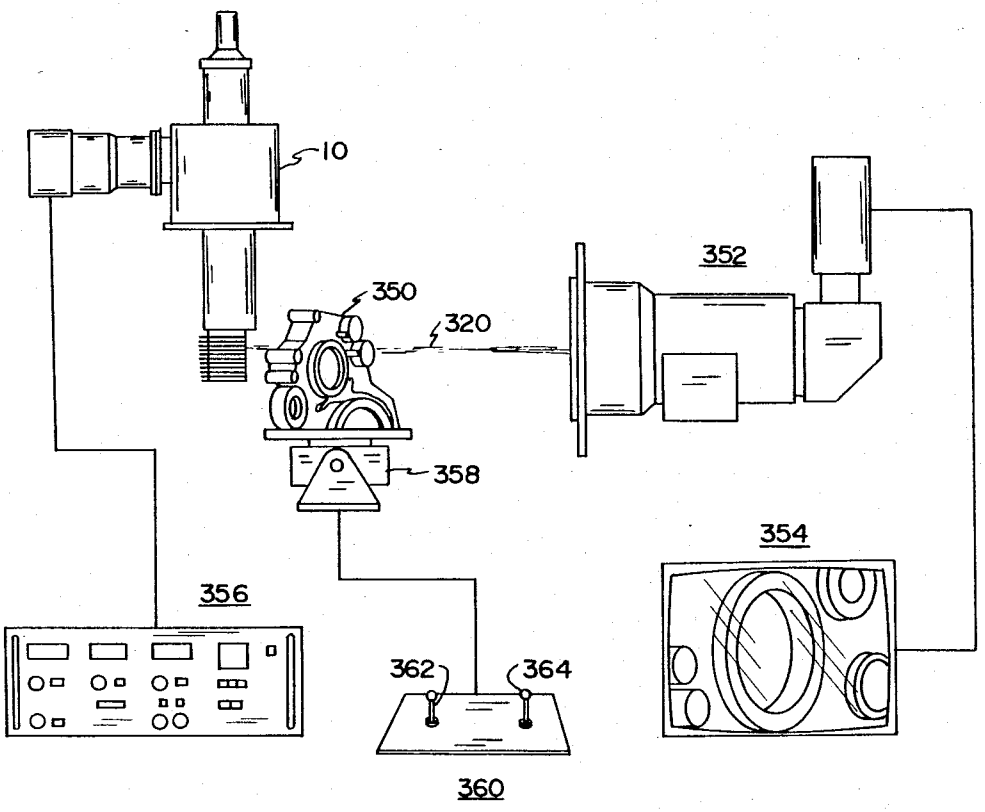
FIG. 7 illustrates the various components preferred for real time viewing using the microfocus X-ray system.

FIG. 7 generally illustrates a complete real time viewing X-ray system. As shown, a test object 350 is placed in the path of X-ray beam 320 between tube 10 and an image intensifier 352. Image intensifier 352 is conventional and converts an X-ray pattern of the object into electrical signals, which are then fed to a conventional monitor 354 upon which the pattern of the portions of the object being X-rayed are displayed, as shown. The control system, indicated with the numeral 356, is illustrative of the circuitry portion of FIG. 1 and generally enables control of tube 10 as described. Object 350 is shown mounted on a conventional manipulating table 358, and it is conventionally controlled by control 360, having appropriate operating controls, illustrated by control knobs 362 and 364 whereby the position of object 350 may be generally varied.

To review operation, first, of course, tube 10 would have been evacuated by operation of pumps 46 and 48 as described. Of course, during this procedure, vent valve 78 would be closed. Next, with the operating potential supplied, the focusing potential would be calibrated by operating variable power supply 44 through a range of voltages, for example, from 10 KV D.C. to 160 KV D.C. At selected incremental points, focusing current levels for these voltages would be stored in memory 308 as previously described. This having been done, an object, such as shown in FIG. 7, would be placed on table 358 for X-raying, and an operator would select a voltage output for power supply 44 which would produce a selected X-ray output. This would depend somewhat on the degree of magnification which is to be employed with respect to the viewing of object 350. Magnification is varied by varying the relative position of object 350 between X-ray tube 10 and image intensifier 352. Thus, in order to increase magnification, the object is moved toward the source of X-ray beam and away from the image intensifier. By virtue of the present system which provides an extremely small focal spot size at significantly high power levels, the magnification effect may be significantly improved. Thus, whereas in the past where the spot size was relatively large for real time viewing, when one attempted to effect significant magnification, the resolution of X-ray examination readily deteriorated. The real cause is the penumbra or the area of partial illumination or shadow on all sides of full radiation intensity. Since X rays are emitted statistically from any point within the focal spot, crisscrossing of these rays occur, especially with larger focal spots. A microfocus source is nearly a point source where the X rays all seem to come from a single focal point with little or no penumbra. This small focal spot decreases fuzziness and increases detail. As an example of the difference, previously with X-ray systems employable for real time viewing, the limits of magnification were on the order of two to three times. On the other hand, with the present system employing an approximate 10 micron beam, geometric magnifications of up to 100 times may be achieved with acceptable detail. Not only does this technique produce significantly sharper film radiographs, but it in a large measure overcomes the limited resolution of real time imaging systems by presenting to the imaging system an already enlarged image having greatly improved detail.

Another significant benefit provided by the present system is that of increased X-ray image contrast, this being related to geometric enlargement and occurs because the image intensifier receives less scattered radiation when the test object is moved away from the image receptor. This is because the intensity of an X-ray beam falls off as the square of the distance, and thus scattered radiation has less effect. Further, by virtue of the automatic focus control, an operator need not repeatedly adjust focus voltages in order to obtain an optimum beam size.

In addition to the improvement in quality of performance, other operating advantages are achieved. Thus, by virtue of the demountability of the tungsten target, it may be operated quite close to the melting point of the tungsten target, a risk which would not be prudent with a sealed tube design. Second, by virtue of the fact that the high level electron beam is steerable, it may be readily moved over the area of the target when a burn occurs or kept in continuous motion for stereo or tomographic techniques.

Further, the target is particularly constructed, being made of sintered tungsten with a thorium additive, and as such, it provides improved target life as compared with conventionally melted tungsten. Beyond this, by virtue of the demountability of the tube, a new target may be installed. Similarly, new or different shaped anodes (e.g., having an annular opening) may be installed. Further, not only may a new filament be readily replaced, but by virtue of the plug-in filament and bias cup arrangement, the filament and grid elements may be precisely aligned before being installed. This prealignment procedure enables both- fast and accurate filament and/or grid replacement.

Having thus described my invention, what is claimed is:

1. An X-ray system comrising:

an elongated vacuum enclosure having first and second vacuum chambers;

electron beam generation means positioned in said first chamber and comprising a filament-cathode and a grid spaced from said filament-cathode, said grid having an aperture through which an electron beam emitted by said filament-cathode passes in a line which is generally along the longitudinal dimension of said enclosure, said beam passing from said first chamber into said second chamber;

said second chamber being tubular and extending around said electron beam;

a focusing coil wound around said tubular second chamber;

an anode having an opening therethrough for passage of said electron beam, said anode being positioned intermediately between said grid and said focusing coil;

a sintered metal tungsten target positioned at an extreme end of said second chamber which is downstream in terms of the passage of said beam, and said target being electrically connected to said anode;

a first pair of beam deflection coils positioned on first and second opposite sides of said second chamber and positioned, with respect to said electron beam, between said said focusing coil and said target, and a second pair of deflection coils positioned on opposite sides of said second chamber, orthogonally with respect to, said first pair of deflection coils;

a window of X-ray permeable material positioned adjacent to said target through which emitted X rays, responsive to bombardment of said target by said electron beam, pass from said second chamber;

first biasing means for applying a heater voltage to said filament-cathode, second biasing means for adjustably applying a negative voltage to said grid with respect to said filament-cathode, and third biasing means for adjustably applying an accelerating voltage to said anode, said accelerating voltage being connected as a ground potential to said anode and as a negative potential on said filament-cathode;

power control means responsive to both the voltage of said third biasing means and electron beam current passing in circuit between said filament-cathode and target for controllably adjusting the voltage of said second biasing means for effecting a grid bias of a value for maintaining a selected value of electron beam power within the range of 0 to 800 watts;

focusing control means coupled to said focusing coil and responsive to the voltage of said third biasing means for applying an electrical input to said focusing coil of a level which varies as a function of anode-to-filament-cathode voltage for maintaining an electron spot size within the range of 10 to 100 microns; and pressure sensing means for providing an electrical output representative of the pressure within said housing, and pumping means responsive to said electrical signal for maintaining a vacuum pressure in said enclosure of between 10 to $10^{-6}$ Torr.

2. An X-ray system as set forth in claim 1 further comprising X-ray imaging means responsive to said X rays for providing a real time visual presentation of X-ray patterns.

3. An X-ray system as set forth in claim 2 wherein:

said system includes a mateable electrical plug attached to and positioned within said first chamber and having first, second, and third mateable conductive members;

said first biasing means includes means for connection, from outside to inside of said first vacuum chamber and to said first and second mateable conductive members, whereby a filament bias is applied to said first and second conductive members;

said second biasing means includes means for connection, from outside to inside of said first vacuum chamber, to said third mateable conductive member of said negative voltage; and said electron beam generation means includes first and second mating electrical conductors connected to said filament-cathode and adapted to interplug with said first and second mateable conductive members, and a third mating electrical conductor connected to said grid and adapted to interplug with said third mateable conductive member, whereby said electron beam generation means may be plugged and unplugged from within said first chamber.

4. An X-ray system as set forth in claim 3 wherein:

said filament includes first and second filament conductive prongs, and said first and second mating electrical conductors include first and second conductive receptacles for receiving said first and second conductive prongs; and said grid has a threaded periphery outboard of said aperture, and said third mating electrical conductor includes a mating threaded receptacle for receiving said grid.

5. An X-ray system as set forth in claim 4 wherein said first and second chambers are openably attached.

* * * * *